US006666706B1

(12) United States Patent
Jones et al.

(10) Patent No.: US 6,666,706 B1
(45) Date of Patent: Dec. 23, 2003

(54) INSULATION DISPLACEMENT CONNECTION CONNECTOR HAVING IMPROVED CONNECTION FEATURES BETWEEN COVER AND BODY THEREOF

(75) Inventors: Dennis B. Jones, Orange, CA (US); George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/283,945

(22) Filed: Oct. 29, 2002

(51) Int. Cl.[7] ..... H01R 11/20
(52) U.S. Cl. ..... 439/405; 439/404; 439/353
(58) Field of Search ..... 439/404, 405, 439/417, 353, 358, 357

(56) References Cited

U.S. PATENT DOCUMENTS 4,484,791 A * 11/1984 Johnson ..... 439/404
4,538,873 A * 9/1985 Worth ..... 439/404
5,893,773 A 4/1999 Dellinger
6,575,780 B1 * 6/2003 Lee ..... 439/404

* cited by examiner

*Primary Examiner*—Lynn Feild
*Assistant Examiner*—Son V. Nguyen
(74) *Attorney, Agent, or Firm*—Wei Te Chung

(57) ABSTRACT

An IDC connector (10) is used for connecting a flat cable (40) to a header connector (60) mounted on a PCB (70). The IDC connector has a cover (30) forming at each end thereof an outer U-shaped locker (34) and an inner latch (36), and a base (52) receiving a plurality of terminals (550) therein for terminating the cable. The cover is enagagable with the base at an initial position and a final position. At the initial position, the lockers of the cover engage with projections (530) of the base with a space between a scalloped bottom face (32) of the cover and a terminating face (522) of the base so that the flat cable is movable on the terminating face. At the final position, the inner latches engage with steps (534) formed by the base and the scalloped bottom face fittingly depresses the flat cable against the terminating face, in which the terminals electrically engage with conductors (402) in the cable, respectively. The base further has deflectable hooks (540) at lateral side ends thereof. The hooks (540) engage with crossbars (627) of the header connector when the IDC connector mates with the header connector. An excessively inner deflection of the hooks is prevented by an engagement between the hooks and lateral side faces (527) of the base, and an excessively outer deflection of the hooks is prevented by an engagement between the hooks and the inner latches of the cover.

2 Claims, 5 Drawing Sheets

INSULATION DISPLACEMENT CONNECTION CONNECTOR HAVING IMPROVED CONNECTION FEATURES BETWEEN COVER AND BODY THEREOF

BACKGROUND OF THE INVENTION

1. Field of the Invention

The present invention relates to an Insulation Displacement Connection (IDC) Connector, and particularly to such connector having improved connection structure between a cover and a body of the IDC connector and between the IDC connector and a complementary header connector mounted on a printed circuit board.

2. Description of Related Art

To connect a flat cable to a printed circuit board (PCB), an IDC connector is usually used to terminate the flat cable. A header connector is mounted on the PCB. Then, the IDC connector mates with the header connector so that the flat cable is electrically connected with the PCB.

U.S. Pat. No. 5,893,773 disclosed an IDC connector which has protuberances on sidewalls of a body of the connector so that a cover of the connector can be positioned at an initial position before being pushed to a final position. At the initial position, a flat cable is movable on a terminating face of the body of the connector. At the final position, the cable is compressed between the cover and the body and pierced by terminals of the connector so that conductors in the cable electrically engage with the terminals.

For such a conventional IDC connector, the position of the cover on the body at the initial position is not ensured, since the cover may separate upwardly from the body during transportation of the connector. Furthermore, there is no structure on the body of the IDC connector which can securely fasten the connector to a header connector mounted on a PCB so that a reliable electrical connection between the flat cable and the PCB cannot be always ensured.

Therefore, it is necessary to provide an improved IDC connector which can overcome the disadvantages of the prior art.

SUMMARY OF THE INVENTION

Accordingly, an object of the present invention is to provide an IDC connector in which a cover of the connector can be reliably located at an initial position so that the cover will not separate from the body during transportation of the connector before the connector is motivated to terminate a flat cable therein.

Another object of the present invention is to provide an IDC connector in which a body thereof has hook structure for engaging with a header connector mounted on a PCB, whereby the IDC connector and the header connector can be securely connected together so that a flat cable terminated by the IDC connector can have a reliable electrical connection with the PCB.

To achieve the above objects, an IDC connector in accordance with the present invention comprises a cover and a body. The cover has formed at each of two opposite ends thereof an outer U-shaped locker and an inner latch between two vertical beams of the U-shaped locker. The body has formed at each of its two opposite ends a tower, and has an upper terminating face and a lower mating face. A plurality of terminals is secured in the body and each has a terminating section located above the terminating face. The tower defines a passage therein, projections protruding laterally outwardly, and steps located below the projections and beside the passage. The body further has a hook integrally extending downwardly from the tower. The hook is deflectable and has a lower catch. The cover is assembled to the body at two positions, i.e., an initial position and a final position. At the initial position, the outer lockers engage with the projections, the inner latches abut against slated faces formed by the towers and a scalloped bottom face of the cover is spaced from the terminating face a distance so that the flat cable is movable along the terminating face. The cover is pushed towards the body from the initial position to reach the final position in which inner latches engage with the steps and the scalloped bottom face of the cover depresses the flat cable against the terminating face so that termination sections of the terminal pierce through the flat cable and clamp conductors of the flat cable, respectively. The IDC connector mates with a header connector mounted on a printed circuit board. The catches of the hooks of the body of the IDC connector engage with crossbars formed on lateral sides of the header connector to thereby lock the IDC connector and the header connector together. An excessively inward deflection of the hooks is prevented by an engagement between the hooks and lateral side faces of the body. An excessively outward deflection of the hooks is prevented by an engagement between the hooks and the inner latches when the cover is assembled to the body at the final position.

Other objects, advantages and novel features of the invention will become more apparent from the following detailed description when taken in conjunction with the accompanying drawings.

DETAILED DESCRIPTION OF THE INVENTION

Figure 1:
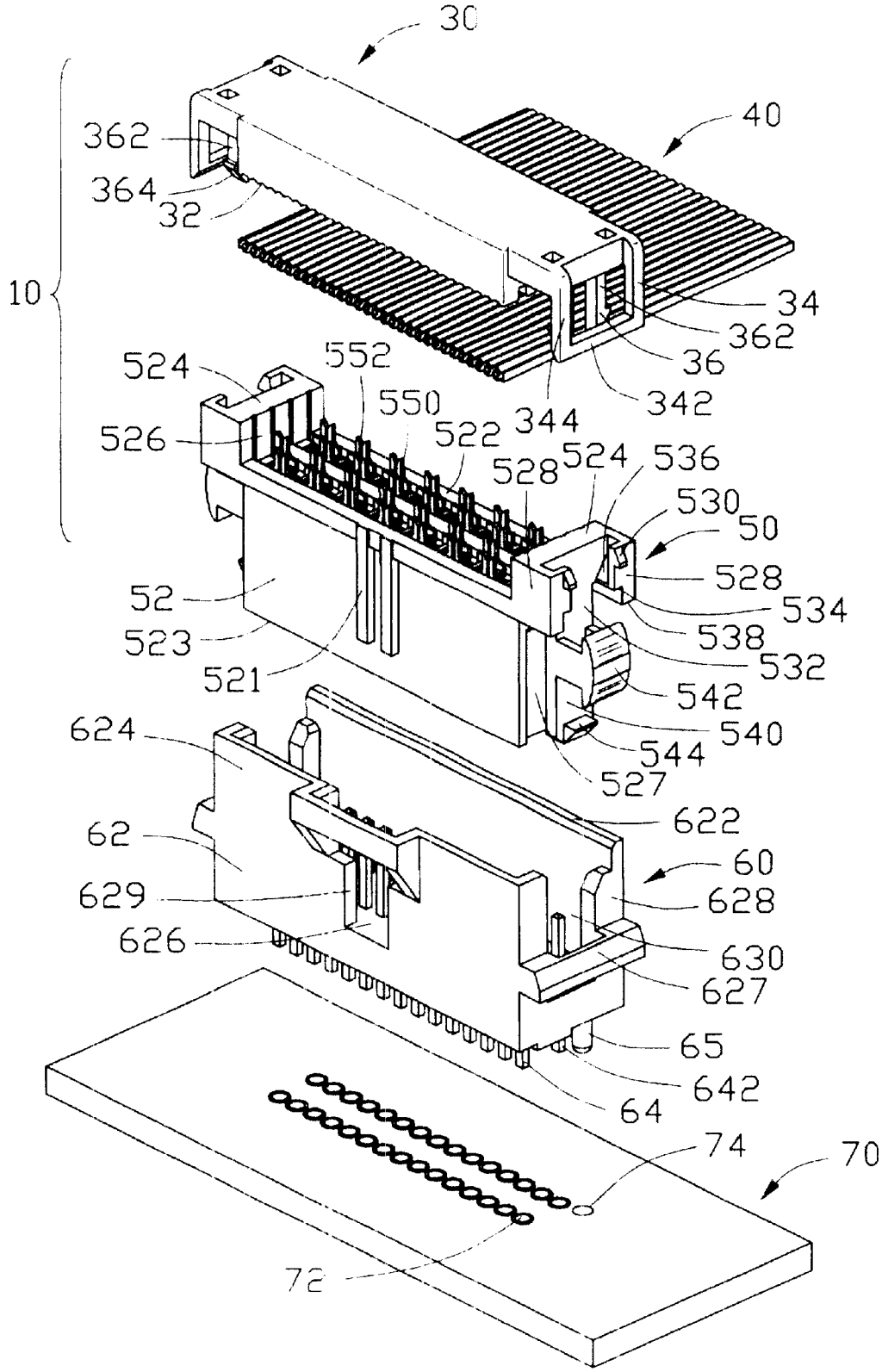
FIG. 1 is a perspective exploded view of an IDC connector and a header connector in accordance with the present invention, in which the IDC connector is for terminating a flat cable and the header connector is for mounting to a PCB.

Reference will now be made to the drawing figures to describe the present invention in detail.

Figure 2:
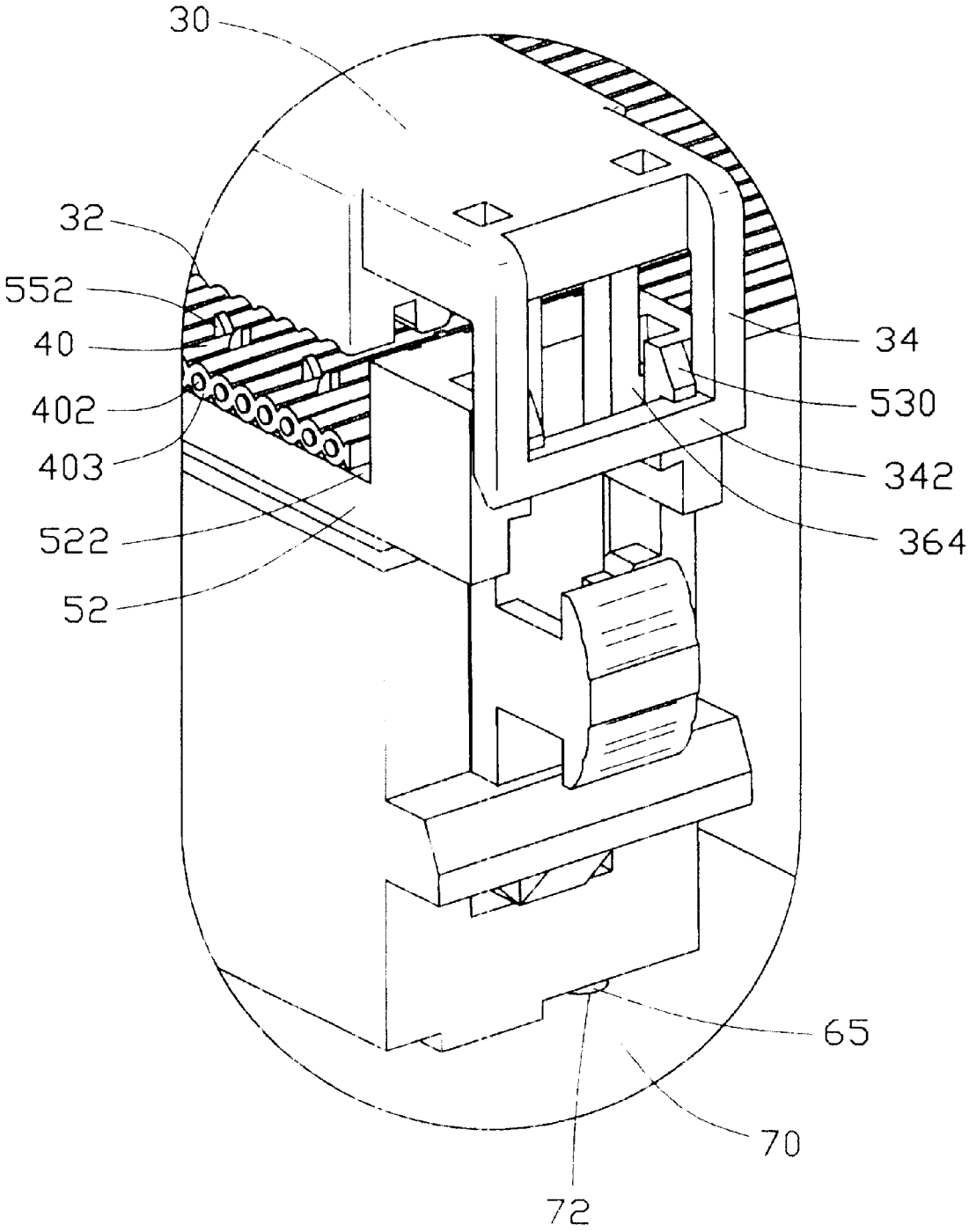
FIG. 2 is a perspective view showing a cover of the IDC connector is mounted to a body thereof at an initial position, the cable being received between the cover and the body, the body mating with the header connector and the header connector being mounted to the PCB.

Referring to FIG. 1, an IDC connector 10 for terminating a flat cable 40 includes a cover 30 and a body 50. The cable 40 has conductors 402 side-by-side arranged in a jacket 403 (FIG. 2). The cover 30 is formed by plastics injection molding and has an elongated configuration with two lateral ends each being provided with an outer U-shaped locker 34 having a horizontal bottom beam 342 and an inner latch 36 consisting of two latching arms 362. The latching arms 362 are provided with hooked bottom ends 364 pointing forwardly and rearwards. The latch 36 is located between two vertical beams 344 in a front-to-rear direction. The cover 30 further has a scalloped bottom face 32 for fitting with the flat cable 40. The bottom beam 342 interconnects bottom ends of the vertical beams 344 of the U-shaped locker 34.

The body 50 has an insulating base 52 defining a top terminating face 522 and a bottom mating face 523. Two slots (not labeled) are defined in the base 52 from the terminating face 522 to the mating face 523. Each slot receives two rows of terminals 550 therein. Each terminal 550 has a fork-shaped termination section 552 projecting upwardly beyond the terminating face 522. The termination section 552 is used for piercing through the jacket 403 of the flat cable 40 and clamping a corresponding conductor 402 whereby the terminals 550 and the cable 40 can be electrically connected together. The base 52 has an elongated configuration with two lateral ends each being provided with a tower 524. The towers 524 has two inner faces 526 above the terminating face 522 and facing each other, which are spaced from each other a distance equal to a width of the flat cable 40. Thus, the cable 40 can be guided by the inner faces 526 to be precisely terminated by the termination sections 552 of the terminals 550. Each tower 524 has front and rear walls 528 defining a passage 532 therebetween. Either the front or the rear wall 528 has an inner slanted face 536 facing the passage 532 and flaring upwardly, a laterally outwardly protruding projection 530 and a step 534 facing the passage 532 and located below the projection 530. A hook 540 integrally extends downwardly from the tower 524, having a push-button 542 extending laterally outwardly generally from an upper end thereof, and a catch 544 projecting laterally outwardly from a lower end thereof. Also referring to FIG. 5, a gap 525 is defined between a lateral side face 527 of the base 52 and a corresponding hook 540 so that the hooks 540 are deflectable within a limited range. Two vertically extending ridge 521 are formed on a front wall of the base 52 for providing a polarization function to the IDC connector 10 so that it can correctly mate with a header connector 60.

The header connector 60 is used for receiving and electrically connecting with the IDC connector 10. The header connector 60 has an insulating housing 62 with a front wall 624, a rear wall 622 and a bottom wall 626 connecting bottom ends of the front and rear walls 624, 622. Header pins 64 are fitted to the bottom wall 626 with solder tails 642 extending downwardly beyond a bottom face of the bottom wall 626. Two crossbars 627 are respectively provided at two lateral walls 628 of the housing 62. Each lateral wall 628 is provided with an opening 630 extending downwardly from a top edge thereof to a position below a corresponding crossbar 627. A rectangular hole 629 is defined in a middle of the front wall 624 for receiving the ridges 521 of the base 52 when the IDC connector 10 mates with the header connector 60. A post 65 is integrally extended from the bottom face of the bottom wall 626 which is used for properly locating the header connector 60 on a PCB 70.

The PCB 70 defines two rows of plated through holes 72 and an non-plated through hole 74 beside the holes 72. When the header connector 60 is mounted on the PCB 70, the solder tails 642 of the terminals 64 are fitted in the plated through holes 72, and the post 65 is fitted in the hole 74. Thereafter, the PCB 70 and the header connector 60 combination is subjected to a wave soldering process thereby soldering the solder tails 642 to the PCB 70 (FIG. 2).

In assembly, referring to FIG. 2, the cover 30 is assembled to the body 50 at an initial position in which the hooked bottom ends 364 of the latching arms 362 engage on the slanted faces 536 (FIG. 1) and the bottom beams 342 (only one shown in FIG. 2) of the U-shaped lockers 34 engage bottoms of the projections 530. Thus, the cover 30 is reliably located at the initial position in which the scalloped bottom face 32 of the cover 30 is spaced from the terminating face 522 of the base 52 of the body 50 a distance and the flat cable 40 is movable on the terminating face 522. Since the bottom beams 342 engage with the projections 530, the cover 30 cannot be moved upwardly to separate from the body 50 during transportation of the combination of the cover 30 and the body 50 at the initial position. Furthermore, unless a sufficiently large predetermined pressing force is applied to the cover 30, the cover 30 cannot be moved downwardly to lock with the body 50 at a final position.

Figure 3:
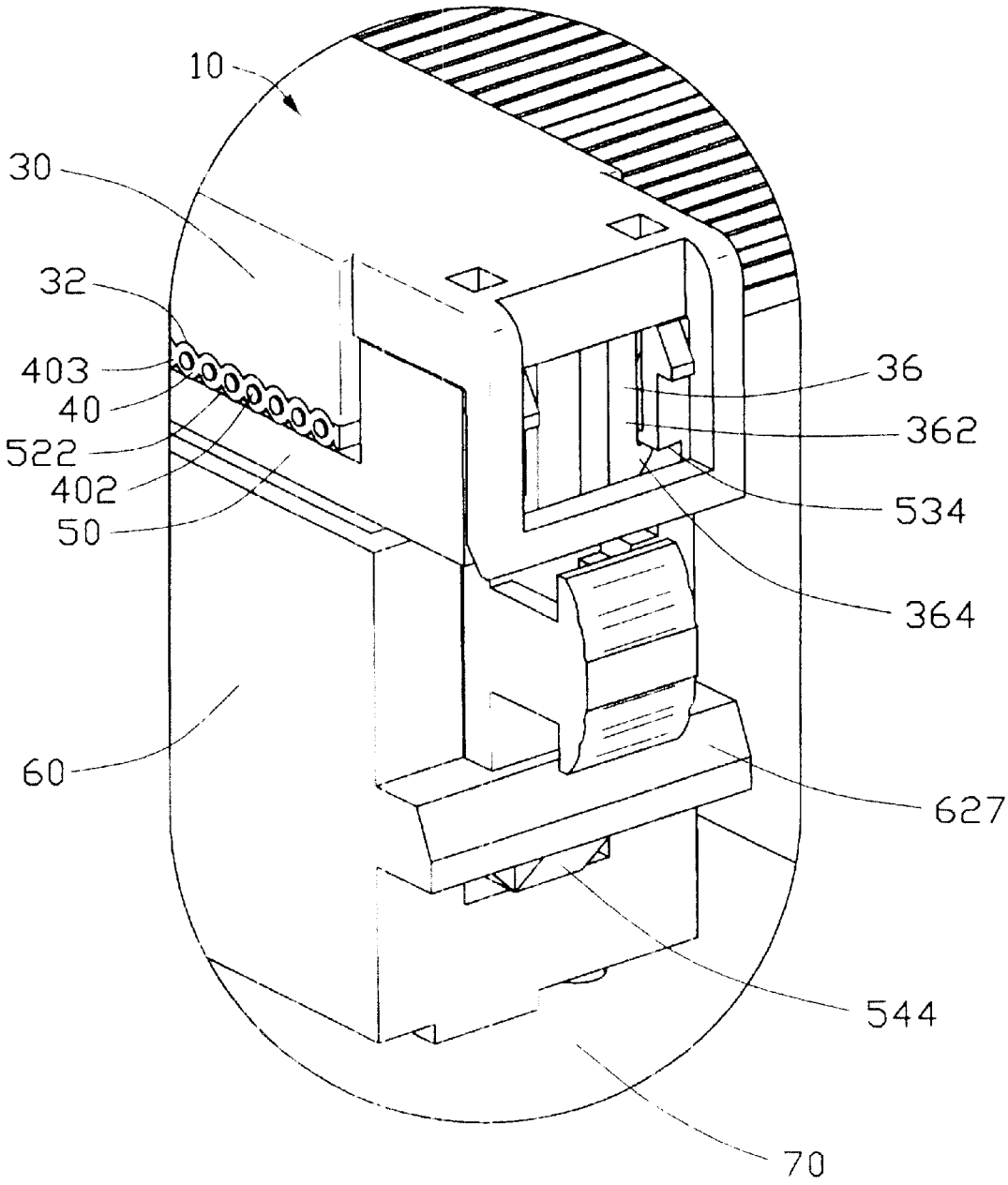
FIG. 3 is a view similar to FIG. 2, but showing that the cover is moved to a final position so that the cable is tightly compressed between the cover and the body.

Referring to FIG. 3, after the flat cable 40 is properly positioned on the terminating face 522, a depressing force larger than the predetermined force is exerted to the cover 30 to push it to reach the final position. At the final position, the scalloped bottom face 32 of the cover 30 fittingly depresses the cable 40 against the terminating face 522 so that the termination sections 552 of the terminals 550 pierce through the jacket 403 of the cable 40 to clamp the conductors 402 of the cable 40, respectively, whereby the terminals 550 are electrically connected with the respective conductors 402. Furthermore, the hooked bottom ends 364 of the latching arms 362 of the latches 36 engage the steps 534, respectively to securely fasten the cover 30 and the body 50 together. During the movement of the cover 30 from the initial position to the final position, the hooked bottom ends 364 move on the inner slanted faces 536 and are deflected towards each other following the downward movement of the cover 30 until the bottom hooked ends 364 engage the steps 534. Finally, the IDC connector 10 together with the flat cable 40 is assembled to the header connector 60 mounted on the PCB 70 by inserting the base 52 of the body 50 into a space of the header connector 60 defined between the front, rear, lateral side and bottom walls thereof to reach a position in which the ridges 521 are received in the hole 629 (FIG. 4), the mating face 523 abuts the bottom wall 626, the catches 544 engage bottom faces of the crossbars 627, respectively, and the header pins 64 electrically engage with the terminals 550, respectively.

Figure 4:
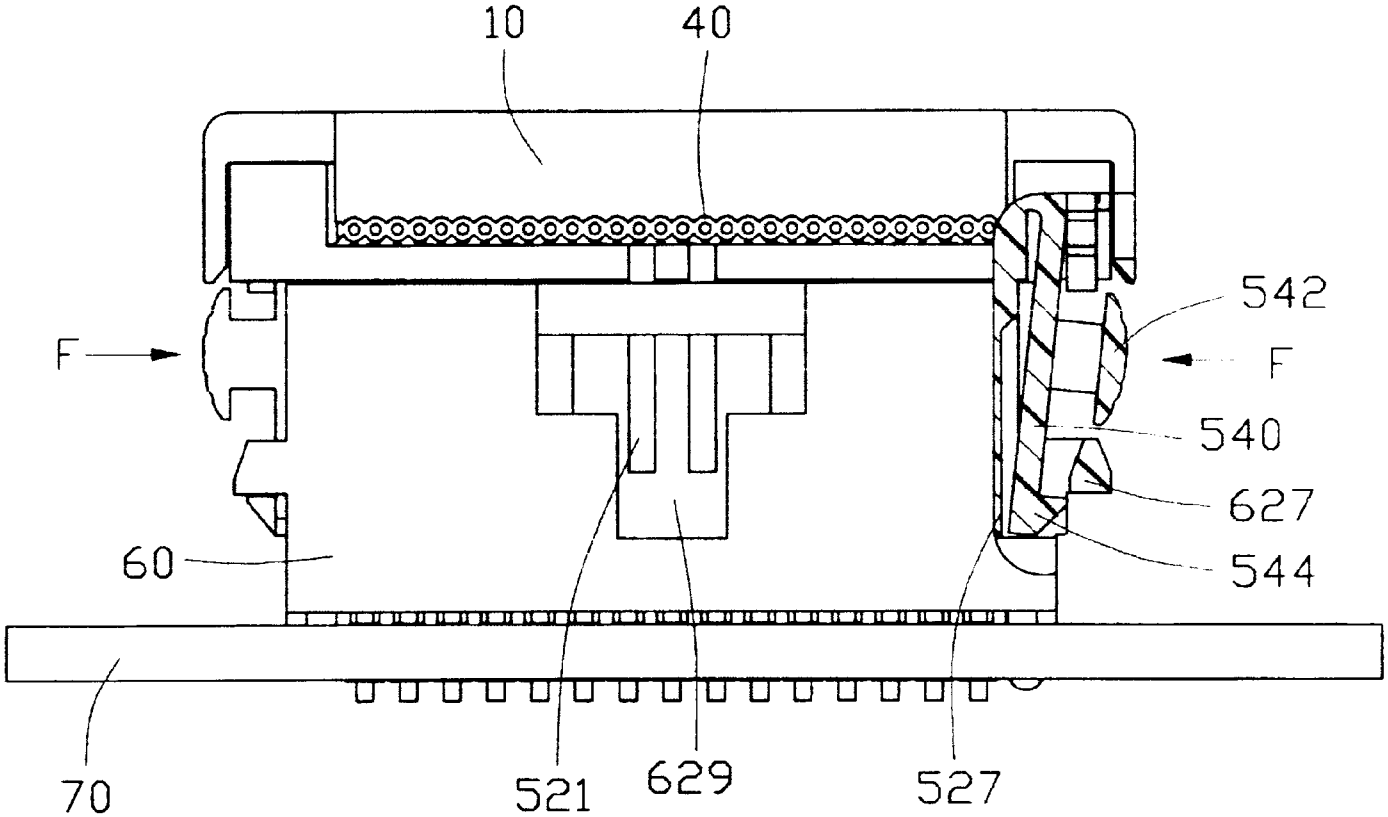
FIG. 4 is a front elevational view, with a portion shown in a cross-sectional manner, of an assembly of the IDC connector, the cable, the header connector and the PCB of FIG. 1.

Referring to FIG. 4, to separate the IDC connector 10 from the header connector 60, the hooks 540 are deflected inwardly toward each other by exerting a push force F on each of the push buttons 542 so that the catches 544 disengage from the bottom faces of the crossbars 627. Then, the IDC connector 10 can be separated from the header connector 60 by exerting an upwardly pulling force to the IDC connector 10. In the present invention, an overstress of the hooks 540 due to the push forces F can be prevented by an engagement between the catches 544 of the hooks 540 and the lateral side faces 527 of the base 52.

Figure 5:
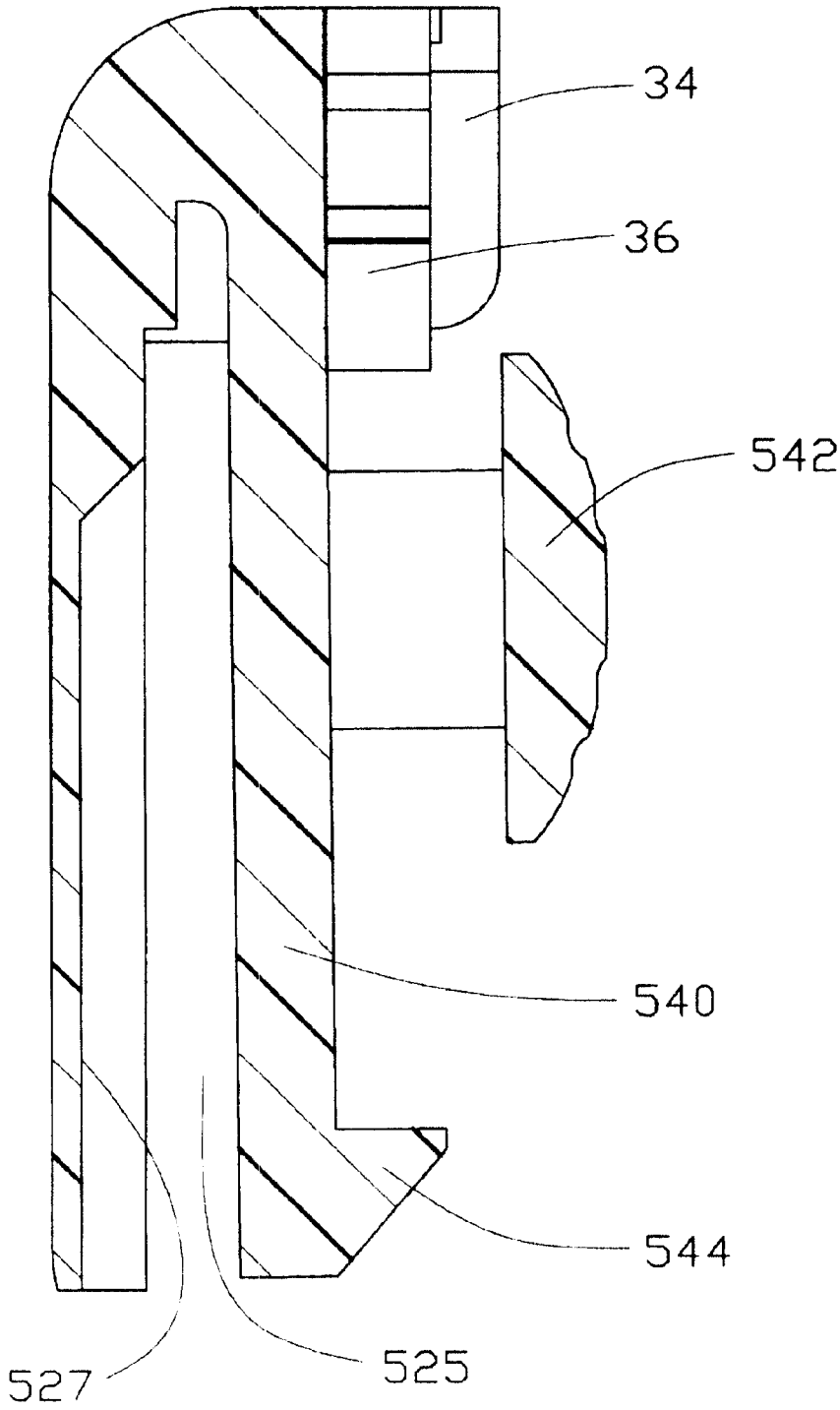
FIG. 5 is a partially cross-sectional view showing a relation between a hook the body and a latch of the cover of the IDC connector when the IDC connector is unmated from the header connector.

Referring to FIG. 5, when the IDC connector 10 is separated from the header connector 60, a possible outward deflection of the hooks 540 by a careless manipulation to the hooks 540 can be prevented by an engagement between the hooks 540 and the latches 36, respectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a cover forming at an end thereof a U-shaped outer locker and an inner latch, and having a scalloped bottom face;

a base having a top terminating face and a bottom mating face adapted for mating with a connector complementary to the electrical connector, and a tower formed at a lateral end of the base, the tower having an upper engaging portion and a lower engaging portion; and a plurality of terminals secured in the base, having terminating sections located above the terminating face adapted for terminating a flat cable;

wherein the cover is assembled to the base at an initial position and a final position, at the initial position, the outer locker engaging with the upper engaging portion so that the cover is prevented from moving upwardly away from the base and the scalloped bottom face of the cover being spaced from the terminating face of the base a distance, at the final position, the inner latch engaging with the lower engaging portion and the scalloped bottom face being located proximate the terminating face of the base; wherein the tower forms a slanted face and at the initial Position the inner latch abuts against the slanted face; wherein the tower defines a passage therein receiving the inner latch, the upper and lower engaging portions being located beside the passage and the slanted face declining toward the passage; wherein the upper engaging portion extends in laterally outward direction and the lower engaging portion faces the passage; wherein the upper engaging portion is in a form of a projection, and the lower engaging portion is in a form of a step; wherein the base further comprises a hook integrally formed at a lower part of the tower, the hook being deflectable and comprising a push button located below the lower engaging portion adapted for receiving a pushing force to deflect the hook toward the terminals and a third engaging portion located below the push button adapted for locking with the complementary connector; wherein the inner latch comprises two latching arms which are deflected toward each other during a movement of the cover from the initial position to the final position.

2. An electrical assembly comprising:

a printed circuit board;

a header connector mounted on the printed circuit board;

an insulation displacement connection (IDC) connector having a body mating with the header connector and a cover positioned on the body, the cover having a first engaging means for engaging with the body at an initial position in which a bottom face of the cover is spaced from the body a distance and the cover is prevented from moving upwardly away from the body while is allowed to be moved downwardly towards the body, and a second engaging means for engaging with the body at a final position which is lower than the initial position and in which the bottom face of the cover is proximate the body, a plurality of terminals being secured in the body and having terminating sections located above an upper terminating face of the body; and a flat cable being movable on the terminating face when the first engaging means engages with the body at the initial position, and being terminated by the terminating sections of the terminals and fixedly sandwiched between the bottom face of the cover and the terminating face of the body when the second engaging means engages with the body at the final position; wherein the body has a slanted face and wherein at the initial position the second engaging means abuts against the slanted face; wherein the body has a hook means for locking the body to the header connector; wherein the hook means is deflectable, and the body has a lateral side face for engaging with and thereby preventing the hook means from being excessively deflected when the hook means is pushed in a direction toward the terminals, and an excessive deflection of the hook means in a direction away from the terminals being prevented by an engagement between the hook means and the second engaging means when the second engaging means engages with the body at the final position.

* * * * *